US008608279B2

(12) United States Patent
Nakazawa

(10) Patent No.: US 8,608,279 B2
(45) Date of Patent: Dec. 17, 2013

(54) LIQUID JETTING APPARATUS AND CAP MEMBER

(75) Inventor: Fumio Nakazawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/427,588

(22) Filed: Mar. 22, 2012

(65) Prior Publication Data

US 2013/0033542 A1 Feb. 7, 2013

(30) Foreign Application Priority Data

Aug. 5, 2011 (JP) ..... 2011-171666

(51) Int. Cl.
*B41J 2/165* (2006.01)

(52) U.S. Cl.
USPC ..... 347/32; 347/30

(58) Field of Classification Search
USPC ..... 347/30, 32
See application file for complete search history.

(56) References Cited

U.S. PATENT DOCUMENTS

| | | | | |
|---|---|---|---|---|
| 5,670,997 | A * | 9/1997 | Sugimoto et al. | 347/30 |
| 5,784,081 | A * | 7/1998 | Ozaki et al. | 347/30 |
| 6,203,136 | B1 * | 3/2001 | Takahashi et al. | 347/32 |
| 6,481,826 | B1 | 11/2002 | Hara et al. | |
| 6,578,949 | B2 * | 6/2003 | Takahashi et al. | 347/30 |
| 6,793,315 | B2 * | 9/2004 | Mitsuzawa et al. | 347/23 |
| 6,913,340 | B2 * | 7/2005 | Tanaka et al. | 347/29 |
| 7,014,291 | B2 * | 3/2006 | Ishikawa | 347/29 |
| 7,311,375 | B2 * | 12/2007 | Suzuki et al. | 347/29 |
| 2001/0012029 | A1 | 8/2001 | Momose | |
| 2008/0192083 | A1 | 8/2008 | Nishida | |
| 2009/0015628 | A1 * | 1/2009 | Matsuura | 347/32 |
| 2009/0207206 | A1 | 8/2009 | Harada | |
| 2009/0225134 | A1 | 9/2009 | Tsukada | |
| 2011/0050799 | A1 * | 3/2011 | Nishida | 347/30 |

FOREIGN PATENT DOCUMENTS

| | | | |
|---|---|---|---|
| JP | H02-085146 | U | 7/1990 |
| JP | 2001-353884 | A | 12/2001 |
| JP | 2002-052742 | A | 2/2002 |
| JP | 2008-221836 | A | 9/2008 |
| JP | 2009-190262 | A | 8/2009 |
| JP | 2009-208356 | A | 9/2009 |
| JP | 2010-149370 | A | 7/2010 |

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A liquid jetting apparatus includes: a liquid jetting head which has a liquid jetting surface including a nozzle placement region at which a plurality of nozzles are open; a cap member which covers the nozzles and which includes a bottom wall and a loop-shaped lip portion provided upright on an outer peripheral portion of the bottom wall to come into close contact with the liquid jetting surface, the bottom wall having a first region which covers the nozzle placement region and a second region which extends out from the first region and does not face the nozzle placement region; a cap driving mechanism which moves the cap member to make contact with or separate from the liquid jetting surface; and a recovery mechanism which is connected to the cap member and performs a recovery operation in a state in which the cap member makes contact with the liquid jetting surface.

18 Claims, 12 Drawing Sheets

LIQUID JETTING APPARATUS AND CAP MEMBER

CROSS REFERENCE TO RELATED APPLICATION

The present application claims priority from Japanese Patent Application No. 2011-171666, filed on Aug. 5, 2011, the disclosure of which is incorporated herein by reference in its entirety.

BACKGROUND OF THE INVENTION

1. Field of the Invention

The present invention relates to a liquid jetting apparatus which jets a liquid and a cap member.

2. Description of the Related Art

In some of conventional liquid jetting apparatuses having a liquid jetting head for jetting liquid from nozzles, when liquid jetting performance from the nozzles deteriorates due to the mixture of foreign substances, bubble, and the like in liquid channels in the liquid jetting head or due to the drying and thickening of the liquid in the nozzles, suction purge for recovering the liquid jetting performance from the nozzles by forcibly discharging the aforesaid foreign substances, bubble, or thickened liquid from the nozzles can be performed. For example, an ink jet printer described in Japanese Patent Application Laid-open No. 2008-221836 includes: a cap member which comes into close contact with a liquid jetting surface on which nozzles are open; and a suction means connected to a suction port formed in the cap member, and executes suction purge that reduces pressure in the cap member and suck out liquid from the nozzles by driving the suction means while the cap member is in close contact with the liquid jetting surface, to thereby discharge foreign substances, bubbles, and the like in the liquid jetting head together with the liquid.

However, when the cap member is separated from the liquid jetting surface after the suction purge, if the cap member is separated from the liquid jetting surface while keeping the cap member in a parallel posture which the cap member had when in close contact with the liquid jetting surface, the cap member separates from the liquid jetting surface violently since the pressure in the cap member is negative after the suction purge, and this violent movement scatters the liquid around. Further, a state in which the liquid links between the cap member and the liquid jetting surface (bridge) sometimes occurs and a position of this bridge is not constant.

As a liquid jetting apparatus in which the aforesaid scattering of the liquid is suppressed and the formation position of the bridge is made constant when the cap member is separated from the liquid jetting surface, Japanese Patent Application Laid-open No. 2009-190262, for instance, discloses a printer in which a cap member is separated while tilting relatively to an ink jetting surface on which nozzles are open and a bridge of ink is locally formed at a portion, of the cap member, that separates from the ink jetting surface last, whereby the scattering of the ink is suppressed.

However, in the printer described in Japanese Patent Application Laid-open No. 2009-190262, when the ink jetting surface and the cap member become large in accordance with an upsizing of the nozzles aiming at improvement in print quality, printing speed, and the like, an amount of the ink forming the bridge of the ink increases. The bridge of the ink spreads to the nozzle jetting surface, and as for a nozzle disposed near the portion, of the ink jetting surface, from which the cap member separates last, the ink forming the ink bridge is likely to enter this nozzle due to a back pressure when the nozzle is opened to the air after the cap member separates. Such discharged ink is ink discharged with the foreign substances, bubbles, or thickened ink in the liquid jetting head, and is often foaming. Therefore, such ink, when sucked into the nozzle, may possibly have an adverse effect on a subsequent liquid jetting operation.

Further, when the liquid remaining in the cap member is discharged by the sucking means after the suction purge while the cap member is tilted relatively to the ink jetting surface and the ink bridge is formed, if the ink around the nozzle near the portion, of the ink jetting surface, from which the cap member separates last connects with the ink bridge, the ink in the nozzle near the portion from which the cap member separates last is uselessly discharged infectiously with the discharge of the ink in the cap member, which may possibly increase an amount of the discharged ink.

SUMMARY OF THE INVENTION

Therefore, it is an object of the present teaching to provide a liquid jetting apparatus in which a formation position of a bridge of liquid is apart from nozzles of a liquid jetting surface as much as possible in order to suppress the liquid forming the bridge from connecting with the liquid in the nozzles.

According to an aspect of the present teaching, there is provided a liquid jetting apparatus which jets a liquid, including: a liquid jetting head which has a liquid jetting surface on which a plurality of nozzles for jetting the liquid are open, the liquid jetting surface having a nozzle placement region at which the nozzles are open; a cap member which covers the nozzles of the liquid jetting head and which includes a bottom wall and a loop-shaped lip portion which is provided upright on an outer peripheral portion of the bottom wall to come into close contact with the liquid jetting surface, the bottom wall having a first region which covers the nozzle placement region and a second region which extends out from the first region and which does not face the nozzle placement region; a cap driving mechanism which moves the cap member to make contact with or separate from the liquid jetting surface of the liquid jetting head; and a recovery mechanism which is connected to the cap member and which performs a recovery operation to discharge the liquid from the nozzles in a state in which the cap member makes contact with the liquid jetting surface, wherein the cap driving mechanism tilts the cap member so as to cause the first region to separate from the liquid jetting surface earlier than the second region under a condition that the cap member separates from the liquid jetting surface.

According to the aspect of the present teaching, when the cap member in the tilting state relative to the liquid jetting surface is separated from the liquid jetting surface after the recovery operation is performed by the recovery mechanism, a bridge of the liquid is formed between the liquid jetting surface and a portion, of the lip portion of the cap member, separating last. Therefore, the second region of the bottom wall of the cap member is extended out from the first region facing the nozzle placement region of the liquid jetting surface and the cap member is tilted so that the first region separates from the liquid jetting surface earlier than the second region. Then, (a tip portion) of a portion, of the lip portion, surrounding the second region separates from the liquid jetting surface last, and the bridge of the liquid is formed between this portion of the lip portion and the portion, of the liquid jetting surface, apart from the nozzle placement region. That is, the formation position of the bridge of the liquid is apart from the nozzles of the liquid jetting surface as much as possible.

By thus setting the formation position of the liquid bridge apart from the nozzles of the liquid jetting surface, it is possible to suppress the liquid forming the bridge from connecting with the liquid in the nozzles formed in the nozzle placement region. This can prevent the liquid once discharged from the nozzles from flowing back into the nozzles. Further, the following effect is also obtained when so-called idle suction to separate the cap member from the liquid jetting surface and discharge the liquid remaining in the cap member by using the recovery mechanism is performed after the recovery operation. That is, it is possible to suppress an increase, in a consumption amount of the liquid, which is caused if the liquid forming the bridge and the liquid in the nozzles connect together and the liquid in the nozzles connecting with the liquid forming the bridge is uselessly discharged infectiously with the discharge of the liquid in the cap member.

DESCRIPTION OF THE PREFERRED EMBODIMENTS

Next, an embodiment of the present teaching will be explained.

Figure 1:
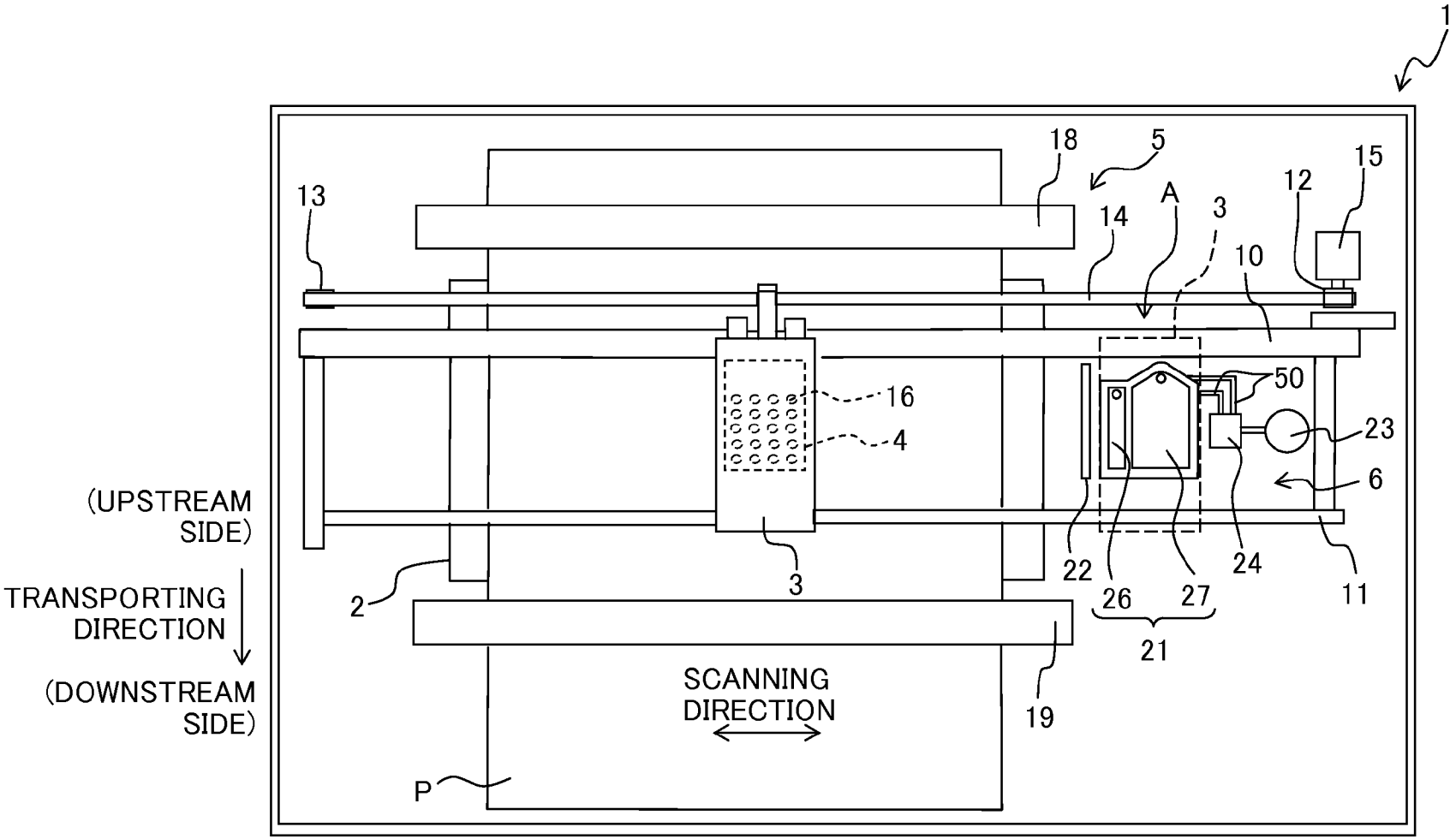
FIG. 1 is a plane view showing a schematic structure of an ink jet printer according to this embodiment.

As shown in FIG. 1, an ink jet printer 1 (liquid jetting apparatus) has: a platen 2 on which a recording paper P is placed; a carriage 3 reciprocatable in a scanning direction parallel to the platen 2; an ink jet head 4 (liquid jetting head) mounted on the carriage 3; a transport mechanism 5 for transporting the recording paper P in a transporting direction perpendicular to the scanning direction; a maintenance unit 6 performing various kinds of maintenance works regarding the recovery and maintenance of liquid jetting performance of the ink jet head 4; and so on.

The recording paper P fed from a paper feeding mechanism (not shown) is placed on an upper surface of the platen 2. Further, two guide rails 10, 11 extending in parallel to the left and right direction in FIG. 1 (scanning direction) are provided above the platen 2, and the carriage 3 is configured to be reciprocatable in the scanning direction along the two guide rails 10, 11 in a region facing the platen 2. Further, the two guide rails 10, 11 extend up to a position apart from the platen 2 in the right direction in FIG. 1 along the scanning direction, and the carriage 3 is configured to be movable from the region facing the recording paper P on the platen 2 (recording region) to the position, apart from the platen 2 in the right direction, which is a non-recording region.

Further, an endless belt 14 wound between two pulleys 12, 13 are coupled to the carriage 3, and when the endless belt 14 is driven to run by a carriage driving motor 15, the carriage 3 moves in the scanning direction as the endless belt 14 runs.

The transport mechanism 5 has two transporting rollers 18, 19 disposed to sandwich the platen 2 in the transporting direction, and these two transporting rollers 18, 19 transport the recording paper P placed on the platen 2 to a downstream side in the transporting direction (near side in FIG. 1).

The ink jet head 4 is installed on an underside of the carriage 3, and a lower surface, of the ink jet head 4, parallel to the upper surface of the platen 2 is an ink jetting surface 4*a* (liquid jetting surface: see FIG. 3B) in which a plurality of nozzles 16 are opened. From the nozzles 16 of the ink jetting surface 4*a*, ink is jetted to the recording paper P placed on the platen 2.

Figure 2:
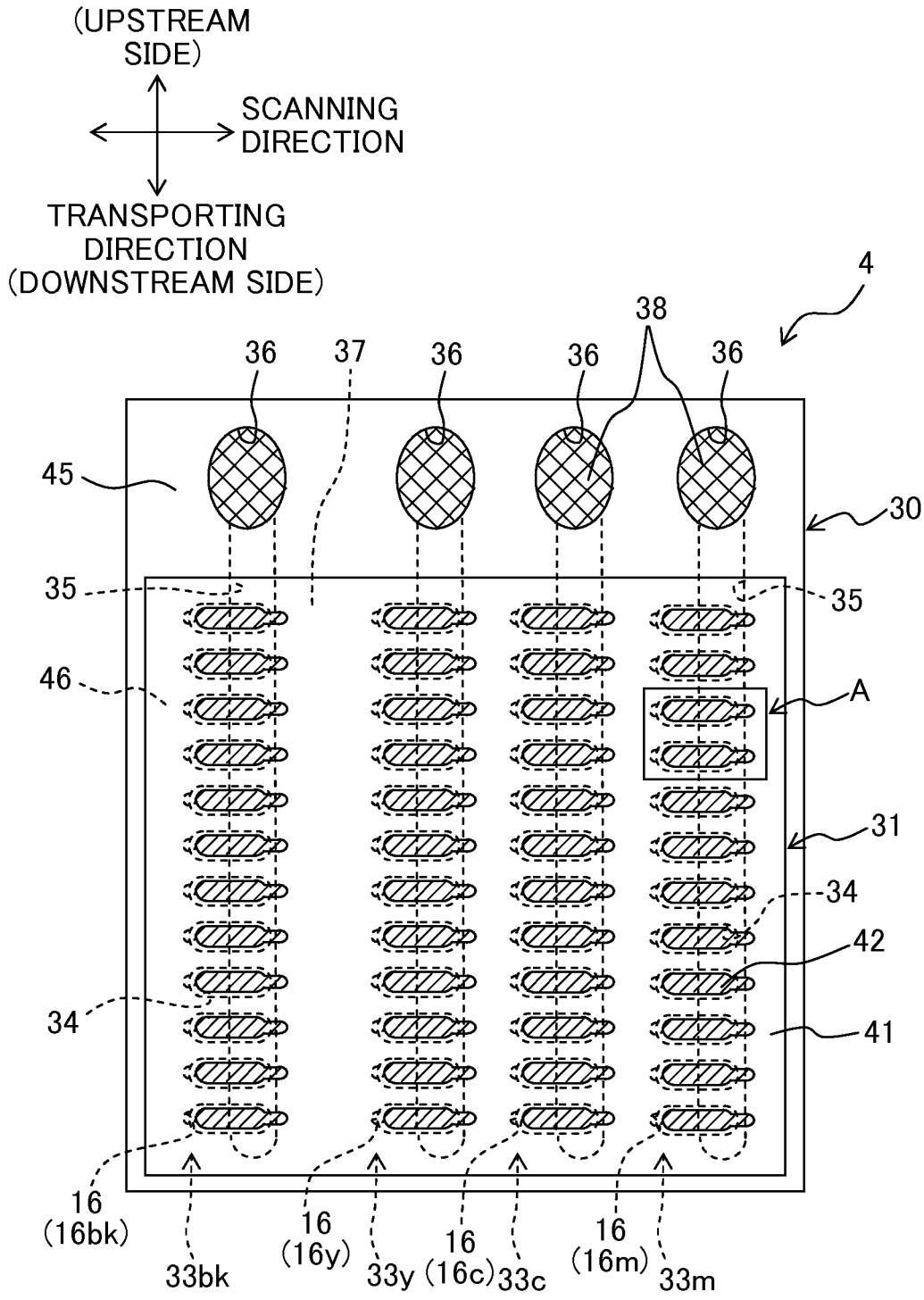
FIG. 2 is a plane view of an ink-jet head.
Figure 3A:
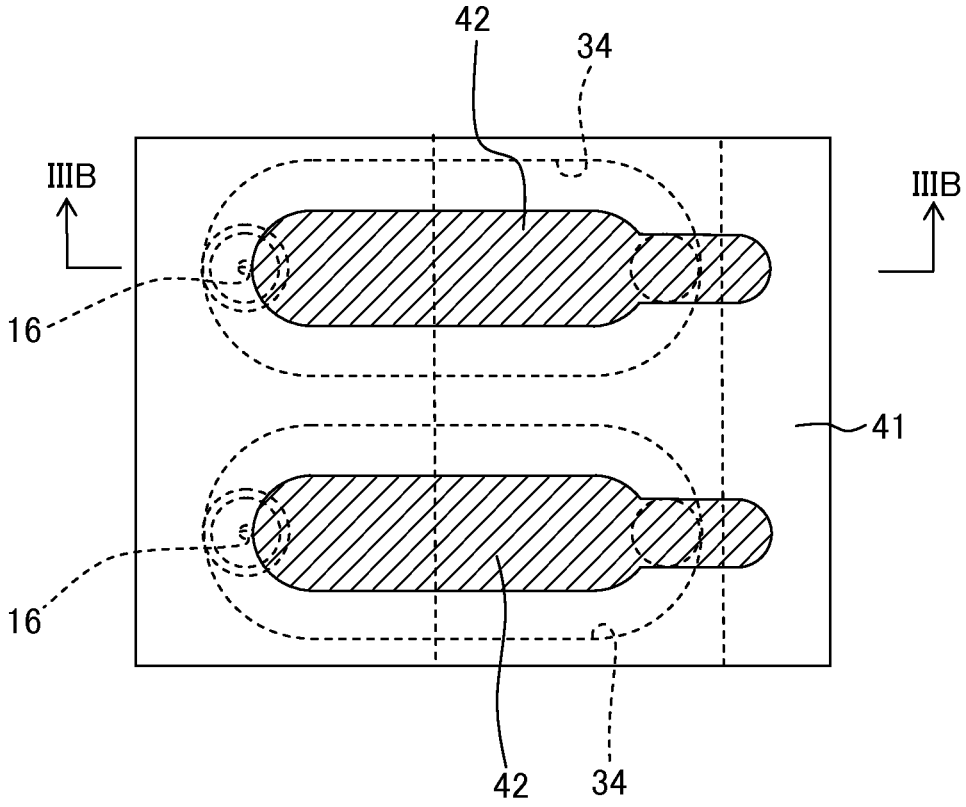
FIG. 3A is an enlarged view of a part A in FIG. 2.
Figure 3B:
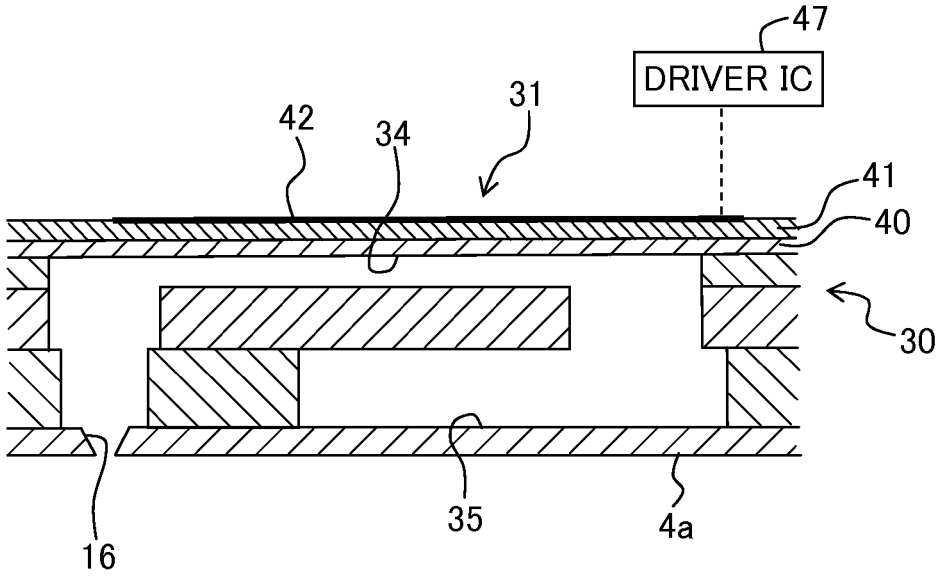
FIG. 3B is a cross-sectional view taken along IIIB-IIIB line in FIG. 3A.

A concrete structure of the ink jet head 4 will be explained. As shown in FIG. 2, FIG. 3A, and FIG. 3B, the ink jet head 4 has: a channel unit 30 in which the nozzles 16 and a plurality of pressure chambers 34 communicating with the respective nozzles 16 are formed; and a piezoelectric actuator 31 disposed on an upper surface of the channel unit 30.

As shown in FIG. 3B, the channel unit 30 includes four stacked plates, and in a lower surface of the channel unit 30 (ink jetting surface 4*a*), the nozzles 16 are formed. As shown in FIG. 2, these nozzles 16 are aligned along the transporting direction to form four nozzle rows 33 arranged in the scanning direction.

From the nozzles 16 (16*bk*, 16*y*, 16*c*, 16*m*) belonging to the respective four nozzle rows 33 (33*bk*, 33*y*, 33*c*, 33*m*), inks in totally four colors are jetted, that is, black ink being a pigment ink and three color inks (yellow, cyan, magenta) being dye inks are jetted. Note that the nozzles 16*bk* jetting the black ink (hereinafter, also referred to as black nozzles 16*bk*) correspond to nozzles belonging to a first nozzle group of the present teaching, and three kinds of the nozzles 16*y*, 16*c*, 16*m* jetting the three color inks (hereinafter, also referred to as color nozzles 16*c*1) correspond to nozzles belonging to a second nozzle group of the present teaching.

Further, on the lower surface (ink jetting surface 4*a*) of the channel unit 30, an empty region 37 exists between the black nozzle row 33*bk* and the color (yellow) nozzle row 33*y*, and a partition wall 21*c* (see FIG. 4) separating two first and second cap portions 26, 27 of a cap member 21 (to be described later) abuts on this region 37.

Further, in the channel unit 30, the pressure chambers 34 communicating with the respective nozzles 16 are formed, and the pressure chambers 34 are also arranged in four rows in correspondence to the four nozzles rows 33. Further, in the channel unit 30, four manifolds 35 each extending in the transporting direction and respectively supplying the inks in four colors of black, yellow, cyan, and magenta to the four pressure chamber rows are formed. Note that the four manifolds 35 are connected to four ink supply ports 36 which are disposed on an upstream side, in the transporting direction, of the region at which the nozzles 16 are formed, and which are formed in an upper surface of the channel unit 30 (surface opposite to the ink jetting surface 4*a*).

The ink supply ports 36 are covered by filters 38, which capture foreign substances in the inks led from ink tanks (not shown) connected to the ink supply ports 36 to prevent the foreign substances from entering a downstream side of the ink supply ports 36 (concretely, the manifolds 35, the pressure chambers 34, and so on). Note that a diameter of each of the ink supply ports 36 is made large and a surface area of each of the filters 38 is made large so that the flow of the inks is not obstructed due to the clogging of the filters 38 by the foreign substances.

The nozzle rows 33 each having the nozzles 16 aligned in the transporting direction are formed, the ink supply ports 36 are disposed on an outer side of the nozzle rows 33 with respect to the transporting direction in plane view, and the manifolds 35 extending from the ink supply ports 36 in the transporting direction and communicating with the nozzles 16 belonging to the nozzle rows 33 are formed in order to make the ink supply ports 36 and the nozzle rows 33 communicate with each other. With this structure, on the lower surface (ink jetting surface 4*a*) of the channel unit 30, there is formed a region 45 which is a region overlapping with the ink supply ports 36 in plane view, which extends out to the upstream side with respect to the transporting direction (nozzle row direction) from a nozzle placement region 46 in which the nozzles 16 are formed, and in which the nozzles 16 are not formed.

As shown in FIG. 3B, the piezoelectric actuator 31 has a vibration plate 40 covering the pressure chambers 34, a piezoelectric layer 41 disposed on an upper surface of the vibration plate 40, and a plurality of individual electrodes 42 disposed on an upper surface of the piezoelectric layer 41 in correspondence to the respective pressure chambers 34. The individual electrodes 42 located on the upper surface of the piezoelectric layer 41 are connected to a driver IC 47 for driving the piezoelectric actuator 31, and a predetermined voltage is applied from the driver IC 47 independently to each of the individual electrodes 42. Further, the vibration plate 40 located on the lower surface of the piezoelectric layer 41 is made of a metal material and plays a role of a common electrode facing the individual electrodes 42 across the piezoelectric layer 41. Incidentally, the vibration plate 40 is connected to a grounding line of the driver IC 47 to be constantly kept at ground potential.

When the predetermined driving voltage is applied between a certain one of the individual electrodes 42 and the vibration plate 40 as the common electrode from the driver IC 47, the piezoelectric actuator 31 causes a change in volume of the pressure chamber 34 owing to piezoelectric deformation (piezoelectric distortion) of the piezoelectric layer 41 sandwiched between the individual electrode 42 and the vibration plate 40, to apply a pressure in the ink in the pressure chamber 34. At this time, the ink is jetted from the nozzle 16 communicating with this pressure chamber 34.

Then, the ink jet printer 1 jets the ink to the recording paper P placed on the platen 2 from the ink jet head 4 reciprocating in the scanning direction (left and right direction in FIG. 1) with the carriage 3, and transports the recording paper P to the downstream side of the transporting direction by the two transporting rollers 18, 19, thereby printing a desired image, characters, and so forth on the recording paper P.

Next, the maintenance unit 6 will be explained. As shown in FIG. 1, the maintenance unit 6 is disposed at a position apart from the platen 2 to one side of the scanning direction (right side in FIG. 1) (maintenance position: position A in FIG. 1 where the carriage 3 is depicted by the two-dot chain line). The maintenance unit 6 has: a cap member 21 made of an elastic material such as rubber and capable of covering openings of the nozzles 16 by coming into contact with the ink jetting surface 4*a* of the ink jet head 4; two cap chips 70, 71 (see FIG. 4) accommodated in the cap member 21; a suction pump 23 (an example of a recovery mechanism) connected to the cap member 21; a wiper 22 wiping off the ink adhered to the ink jetting surface 4*a* after suction purge; and so on.

The wiper 22 is provided upright at a position closer to the platen 2 than the cap member 21, and after the suction purge, the carriage 3 moves in the scanning direction while a tip of the wiper 22 is in contact with the ink jetting surface 4*a*, so that the wiper 22 moves relatively to the ink jetting surface 4*a* to wipe off the ink adhered to the ink jetting surface 4*a*.

Figure 4:
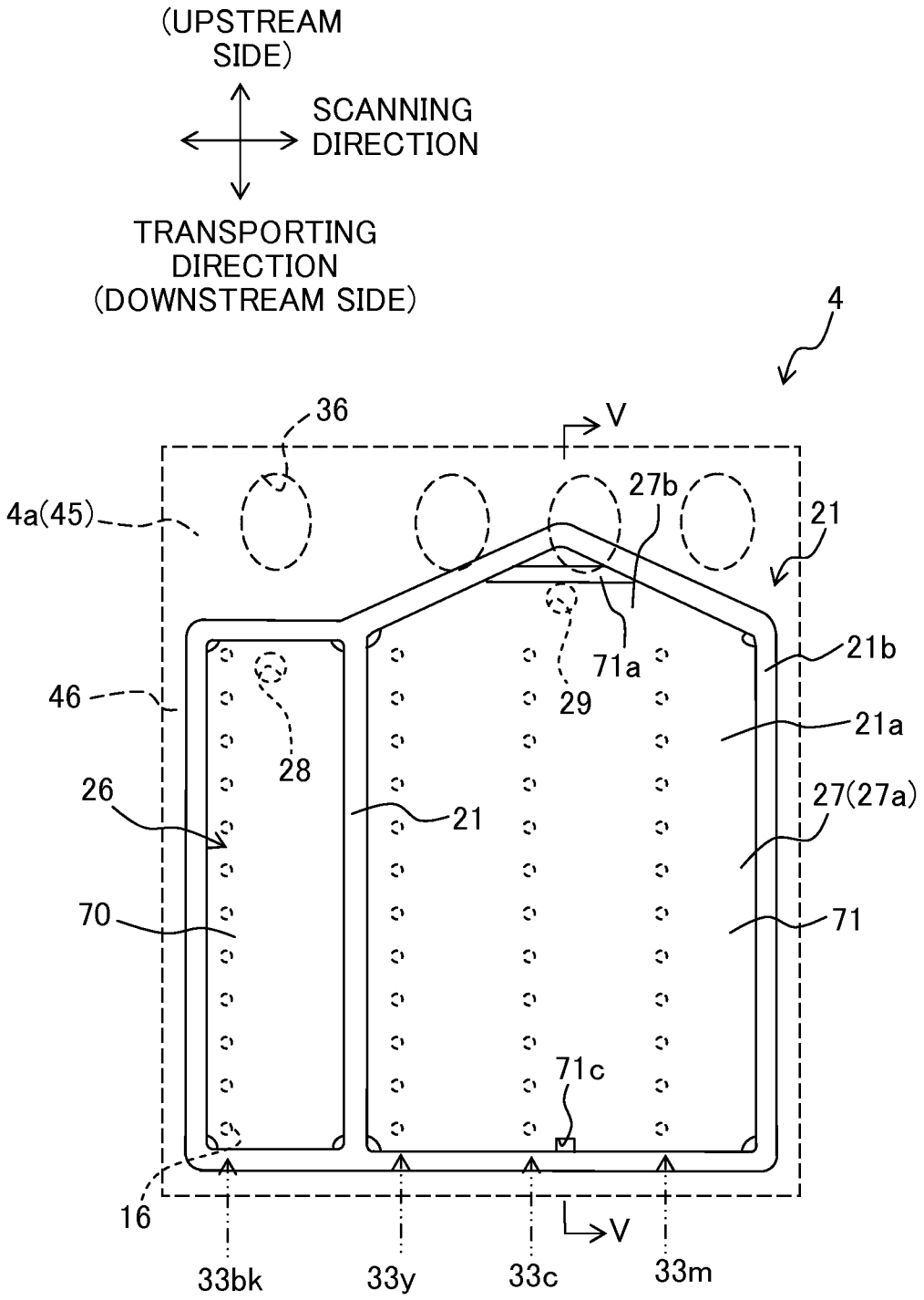
FIG. 4 is a plane view of a cap member.
Figure 5:
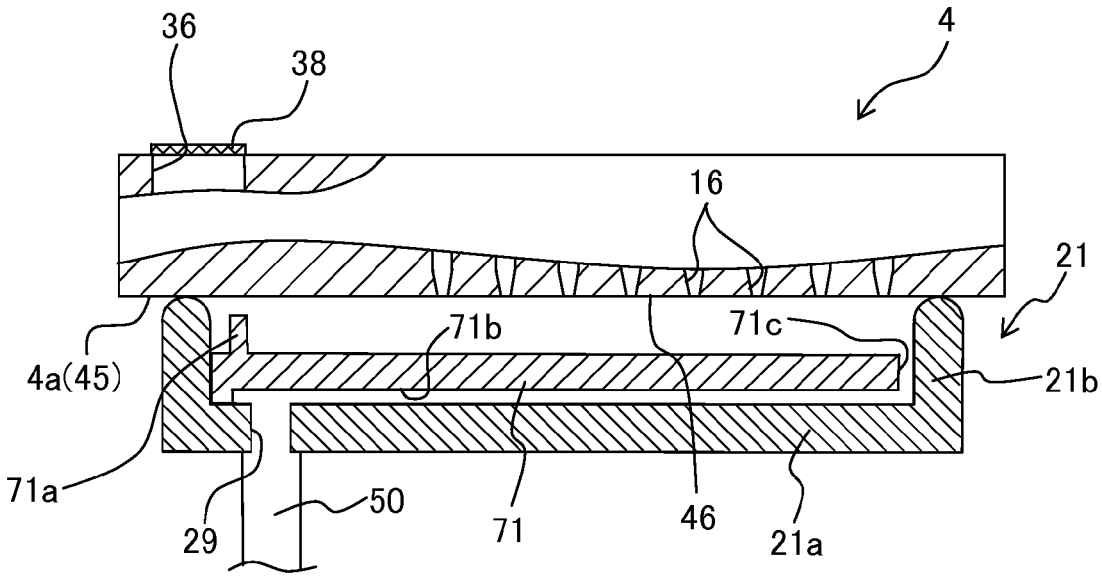
FIG. 5 is a cross-sectional view taken along line V-V in FIG. 4.

Next, the cap member 21 will be explained. In FIG. 4, the ink jet head 4 capped by the cap member 21 is depicted by the two-dot chain line. Further, in FIG. 5, the ink jet head 4 capped by the cap member 21 is depicted by the solid line. As shown in FIG. 4 and FIG. 5, the cap member 21 has a bottom wall 21*a*, a lip portion 21*b* in a loop shape provided upright on an outer peripheral portion of the bottom wall 21*a*, and the partition wall 21*c* provided upright from the bottom wall 21*a*, and these bottom wall 21*a*, lip portion 21*b*, and partition wall 21*c* are integrally molded.

An inner space, of the cap member 21, surrounded by the lip portion 21*b* is partitioned by the partition wall 21*c* provided upright from the bottom wall 21*a* and extending in the transporting direction, so that a first cap portion 26 large enough to cover the black nozzles 16*bk* composing the one nozzle row 33*bk* and a second cap portion 27 covering the color nozzles 16*c*1 (16*y*, 16*c*, 16*m*) composing the three color nozzle rows 33*y*, 33*c*, 33*m* are formed.

The number of the color nozzles 16*c*1 composing the three nozzle rows is larger than the number of the black nozzles 16*bk* composing the single nozzle row, and therefore, the second cap portion 27 large enough to commonly cover the color nozzles 16*c*1 is larger in area (inside volume) than the first cap portion 26 covering the black nozzles 16*bk*. The cap member 21 is brought into contact with or is separated from the ink jetting surface 4*a* by a cap driving mechanism 25 (to be described later) (see FIG. 6A and FIG. 6B), and when it comes into contact with the ink jetting surface 4*a*, the first cap portion 26 covers the black nozzles 16*bk* and the second cap portion 27 covers the color nozzles 16*c*1.

Further, a bottom wall of the second cap portion 27 has: a nozzle facing portion 27*a* (first region) facing the nozzle placement region 46 of the ink jetting surface 4*a*; and an extension portion 27*b* (second region) extending out from the nozzle facing portion 27*a* so as to locally project toward the region 45 which is located on the upstream side of the transporting direction (one side of the nozzle arrangement direction) and in which the nozzles 16 are not formed.

In a bottom wall of the first cap portion 26, a suction port 28 is formed at one end portion in the nozzle arrangement direction (end portion on the upstream side of the transporting direction), and this suction port 28 faces the nozzle placement region 46 of the ink jetting surface 4*a*. Further, a suction port 29 is formed in the extension portion 27*b* of the second cap portion 27, and this suction port 29 faces the region 45, of the ink jetting surface 4*a*, where the nozzles 16 are not formed.

These two suction ports 28, 29 are connected to a switching unit 24 by tubes 50 respectively, and the switching unit 24 is further connected to the suction pump 23. The switching unit 24 has therein a switching valve (not shown), and when the cap member 21 is in a capping state in which the cap member 21 is in close contact with the ink jetting surface 4*a* of the ink jet head 4, the switching unit 24 makes the suction pump 23 communicate with one of the first cap portion 26 and the second cap portion 27. In this state, the suction pump 23 sucks an atmosphere in the cap portion 26 (27) being the communication destination to discharge the ink from the nozzles 16 covered by the cap portion 26 (27). That is, the suction purge of the black nozzles 16*bk* and the suction purge of the color nozzles 16*c*1 are performed independently from each other.

Further, the cap member 21 is also used in a state in which the ink jet head 4 is not used (state in which the ink is not jetted) in addition to being used for the aforesaid suction purge. When the ink jet head 4 is not thus used, the cap member 21 covers the nozzles 16 by coming into contact with the ink jetting surface 4*a* to protect the nozzles 16 and also suppress the drying of the ink in the nozzles 16.

The cap chips 70, 71 are made of synthetic resin or the like, have shapes conforming to outer shapes of the first cap portion 26 and the second cap portion 27, and are accommodated in the first cap portion 26 and the second cap portion 27 respectively to suppress the inward bending of the lip portion 21*b* ascribable to a pressure reduction during the suction purge. As shown in FIG. 4 and FIG. 5, the cap chip 71 accommodated in the second cap portion 27 has a rib 71*a* which is disposed in a portion corresponding to the extension portion 27*b* and which is provided upright to face the region 45, of the ink jetting surface 4*a*, where the nozzles 16 are not formed. The rib 71*a* extends in the scanning direction and is disposed with a clearance from the projecting tip portion of the lip portion 21*b* with respect to the transporting direction. In front surfaces, side surfaces, and rear surfaces of the cap chips 70, 71, through holes, grooves, and concave portions (for example, 71*b*, 71*c* in FIG. 5) are appropriately formed. These through holes, grooves, or concave portions communicate with one another, so that channels through which a space demarcated by the cap member 21 and the ink jetting surface 4*a* communicates with the suction ports 28, 29 are formed in the state that the lip portion 21*b* of the cap member 21 is in contact with the ink jetting surface 4*a*.

The cap member 21 is structured to be capable of tilting with respect to the alignment direction of the nozzles 16 opened in the ink jetting surface 4*a* (transporting direction) when it separates from the ink jetting surface 4*a*, so that the nozzle facing portion 27*a* separates from the ink jetting surface 4*a* earlier than the extension portion 27*b*. That is, the cap driving mechanism 25 separates the cap member 21 from the ink jetting surface 4*a* while keeping the cap member 21 in the tilting state.

Figure 6A:
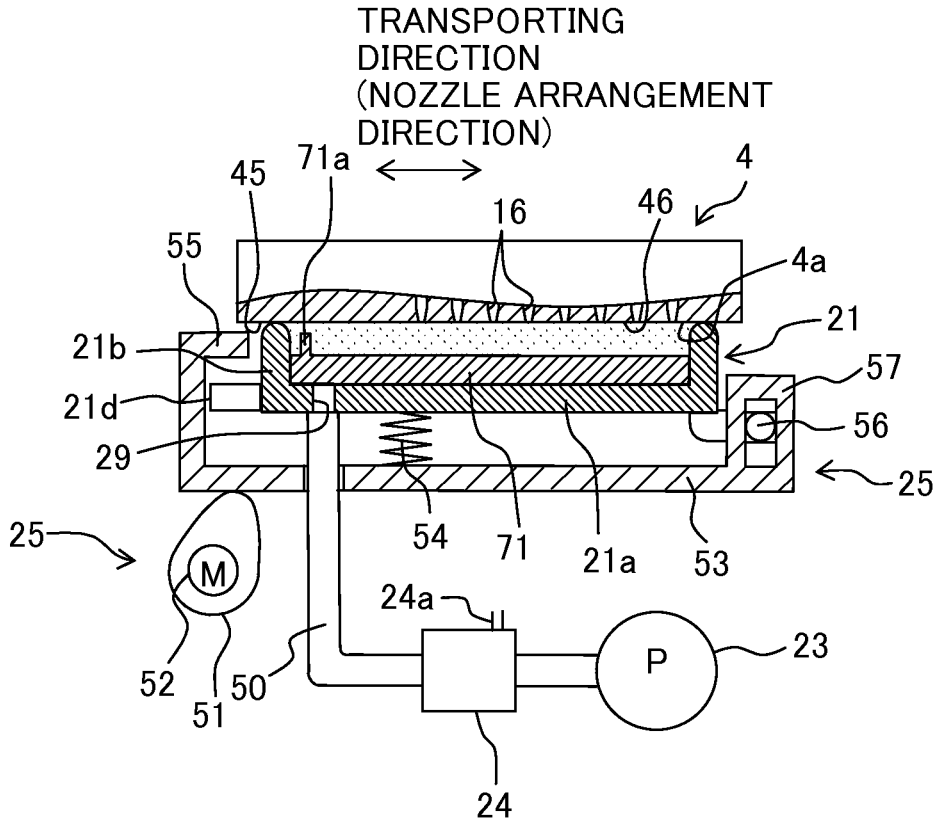
FIG. 6A and FIG. 6B are cross-sectional views of a second cap portion of the cap member and a cap driving mechanism when suction purge is being executed, taken along a vertical surface including a transporting direction, FIG. 6A showing a capping state and FIG. 6B showing a state in which the cap member is separated.

The cap driving mechanism 25 will be explained. As shown in FIG. 6A, the cap driving mechanism 25 has a cam 51 having a predetermined profile, the cam 51 is rotary driven by a cam driving motor 52, and a cap holder 53 for housing the cap member 21 therein. The cap holder 53 has a box shape, with its upper portion opened, and the cap member 21 is housed therein. Further, on an inner bottom portion of the cap holder 53, a coil spring 54 is provided, and the cap member 21 is biased upward by the coil spring 54.

The cap member 21 has a stopper projection 21*d* projecting at one end portion of its bottom wall 21*a* (end portion on one side in the nozzle arrangement direction to which the extension portion 27*b* extends: an end portion on the upstream side of the transporting direction). The cap holder 53 has a stopper 55 in a projecting shape provided at a position corresponding to the aforesaid one side of the cap member 21 and fits on the stopper projection 21*d* of the cap member 21. The stopper 55 is located above the stopper projection 21*d*, and by having the stopper projection 21*d* abut on the stopper 55, the stopper 55 regulates an upper limit position of the cap member 21 biased by the coil spring 54.

Figure 6B:
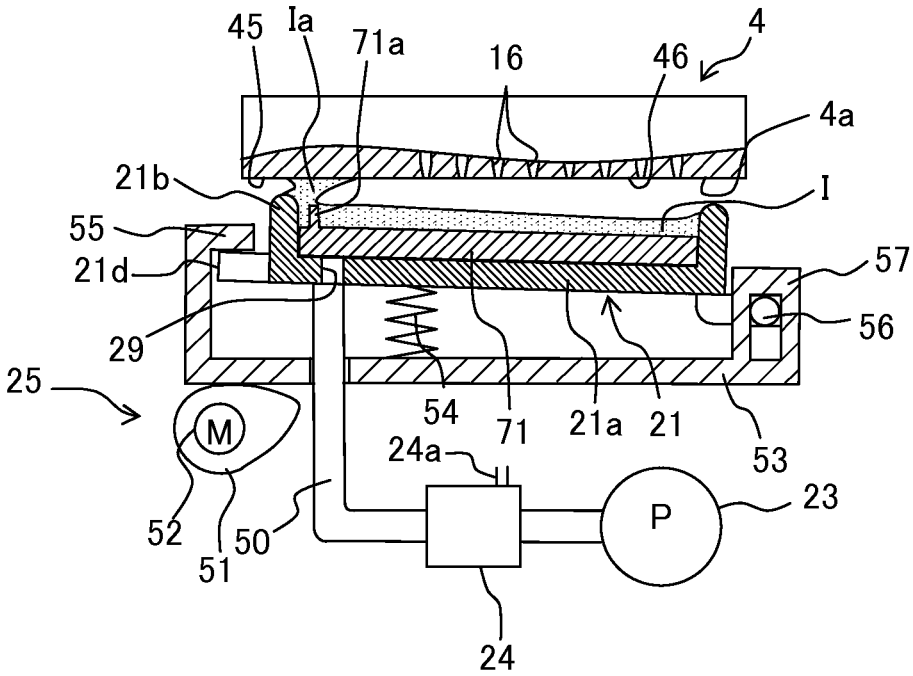

Further, the cap member 21 has a pivot shaft 56 provided at its end portion opposite to the stopper projection 21*d* and extending in a direction perpendicular to the paper in FIG. 6A, and the cap holder 53 has a shaft bearing 57 provided at its end portion opposite to the stopper 55 and slidably supporting the pivot shaft 56 of the cap member 21. Therefore, when the pivot shaft 56 abuts on a ceiling portion of the shaft bearing 57 as shown in FIG. 6B, the cap member 21 pivots with respect to the pivot shaft 56, so that an end portion, of the cap member 21, on a side of the stopper projection 21*d* is movable from a lower limit position where it abuts on an inner bottom surface of the cap holder 53 to the upper limit position where the stopper projection 21*d* abuts on the stopper 55.

A peripheral surface of the cam 51 is in contact with a lower surface of the cap holder 53 housing the cap member 21 in the above-described manner. The cam 51 is rotary driven by the cam driving motor 52, and the cap holder 53 (and the cap member 21) is driven to move up and down according to a phase (rotation angle) of the cam 51.

When the cam 51 rotates anticlockwise while the ink jet head 4 is at the maintenance position A (see FIG. 1), the cap holder 53 is pushed up due to the profile of the cam 51, so that the cap member 21 comes into contact with the ink jetting surface 4*a* to be in the capping state where it covers the nozzles 16, as shown in FIG. 6A. When the suction pump 23 sucks the atmosphere in the cap member 21 in this state, a pressure in the cap member 21 (the first cap portion 26, the second cap portion 27) lowers, so that the ink is discharged from the nozzles 16 into the first and second cap portions 26, 27 (suction purge).

On the other hand, when the cam 51 is rotated from the state in FIG. 6A in a clockwise direction, the cap holder 53 moves down due to its own weight according to the profile of the cam 51. At this time, the cap member 21 is biased upward by the coil spring 54, but at the right end portion of the cap member 21 in the drawing, since the pivot shaft 56 abuts on the ceiling portion of the shaft bearing part 57 of the cap holder 53, the right end portion of the cap member 21 in the drawing first separates as the cap holder 53 moves down. Consequently, as shown in FIG. 6B, the cap member 21 separates from the ink jetting surface 4*a*, with its downstream side in the transporting direction (left side in the drawing) being located higher than its upstream side in the transporting direction (right side in the drawings), that is, in a tilting posture with respect to the nozzle arrangement direction (transporting direction) so that the nozzle facing portion 27*a* separates from the ink jetting surface 4*a* earlier than the extension portion 27*b*.

As described above, when the cap member 21 in the tilting state is separated from the ink jetting surface 4*a*, an ink bridge Ia is locally formed between an end portion, of the cap member 21, separating last (left end portion in the drawing) and the ink jetting surface 4*a* as shown in FIG. 6B. Such formation of the ink bridge Ia only at part of the outer peripheral portion of the cap member suppresses the scattering the ink to a surrounding region when the ink bridge Ia is cut.

Further, in the cap member 21 (second cap portion 27), the bottom wall further extends out from the nozzle facing portion 27*a* facing the nozzle placement region 46 of the ink jetting surface 4*a* to form the extension portion 27*b*, and the cap member 21 is tilted so that the nozzle facing portion 27*a* separates from the ink jetting surface 4*a* earlier than the extension portion 27*b*. As a result, in the lip portion 21*b*, its tip portion surrounding the extension portion 27*b* of the second cap portion 27 separates from the ink jetting surface 4*a* last. Consequently, the ink bridge Ia is formed between the portion, of the ink jetting surface 4*a*, apart from the nozzle placement region 46 and the tip portion of the lip portion 21*b*.

In this manner, since the formation position of the ink bridge Ia is apart from the nozzle placement region 46 (nozzles 16) of the ink jetting surface 4*a*, it is possible to suppress the connection of the ink bridge Ia and the ink in the nozzles 16 placed in the nozzle placement region 46. This can prevent the ink forming the ink bridge Ia from flowing back into the nozzles 16. Further, after the suction purge, when so called idle suction is performed, that is, when the cap member 21 is separated from the ink jetting surface 4*a* and the suction is performed by the suction pump 23 to suck and discharge the ink which is discharged into the cap member 21 in the suction purge, it is possible to suppress an increase in consumption amount of the ink ascribable to the connection of the ink bridge Ia and the ink in the nozzles 16 and the discharge of the ink in the nozzles connecting with the ink bridge Ia. Further, increasing the size of the cap member 21 by the extension portion 27*b* makes it difficult for the ink to spill to the outside of the cap member 21 even if an amount of the ink forming the bridge increases.

Further, since the bridge is formed at the tip portion, of the lip portion 21*b*, surrounding the extension portion 27*b*, a separation distance from the ink jetting surface 4*a* becomes small at one point. Consequently, the ink bridge Ia is concentrated locally, so that the ink does not easily scatter and the ink forming the ink bridge Ia is easily sucked by the suction pump 23. Further, the projecting shape contributes to a reduction in a peripheral length of the portion, of the lip portion 21*b*, forming the extension portion 27*b* and to improvement in sealability with the ink jetting surface 4*a*.

Further, the cap chip 71 is disposed in the cap member 21 (second cap portion 27) and the rib 71*a* is provided upright on the region, of the cap chip 71, disposed on the extension portion 27*b*, so that not only the ink bridge Ia is formed between the lip portion 21*b* forming the extension portion 27*b* of the cap member 21 and the ink jetting surface 4*a*, but also the ink bridge Ia is formed between the rib 71*a* of the cap chip 71 housed in the cap member 21 and the region 45, of the ink jetting surface 4*a*, where the nozzles 16 are not open, and thus the ink bridge Ia are gathered inside the cap member 21, which makes it difficult for the ink forming the ink bridge Ia to spill to the outside of the cap member 21. Further, since the ink connecting with the ink forming the ink bridge Ia enters and is held in a gap between the rib 71*a* and the lip portion 21*b*, it is difficult for the ink forming the ink bridge Ia to spill to the outside of the cap member 21.

Further, it is suitable to provide the extension portion 27*b* in the second cap portion 27 which covers the many nozzles 16 (color nozzles 16*c*1), around which the lip portion 21*b* has a long peripheral length, and in which an amount of the ink forming the ink bridge Ia is large.

Further, since the second cap portion 27 commonly covers the color nozzles 16*c*1 jetting the different color inks respectively, the plural color inks are discharged and mixed in the second cap portion 27 during the suction purge. In order to prevent such mixed color inks from forming the ink bridge Ia, connecting with the ink in the nozzles 16, and flowing back to the nozzles 16, it is suitable to provide the extension portion 27*b* in the second cap portion 27 so that the formation position of the bridge is apart from the nozzle placement region 46 of the ink jetting surface 4*a*.

Further, after the cap member 21 separates from the ink jetting surface 4*a*, the ink pooling in the cap member 21 is sucked to be discharged by the suction pump 23. Incidentally, suction ports 28, 29 are provided near the end portion closer to the ink jetting surface 4*a* (left end portion in the drawing) when the cap member 21 is in the tilting posture in FIG. 6B, that is, near the end portion separating from the ink jetting surface 4*a* last, that is, near the formation position of the ink bridge Ia. Concretely, the suction port 29 is formed in the extension portion 27*b* of the second cap portion 27. This can ensure that the ink pooling in the cap member 21 is discharged.

Further, as described above, the filters 38 cover the ink supply ports 36 in order to remove the foreign substances, and in order to prevent the foreign substances from clogging the filters 38 to obstruct the flow of the ink, the diameter of each of the ink supply ports 36 is made large and the surface area of each of the filters 38 is made large. The ink supply ports 36 and the filters 38 are disposed on a more outer side than the nozzle rows. Consequently, on the outer side of the nozzle placement region 46, the ink jetting surface 4*a* has the area 45 where the nozzles 16 are not formed and the ink supply ports 36 and the filters 38 are disposed. By providing the extension portion 27*b* of the cap member 21 so that it faces the empty region 45, it is possible to make an effective use of the region 45, of the ink jetting surface 4*a*, where the nozzles 16 are not formed.

Next, modification examples where various changes are made to this embodiment will be explained. Note that those having the same structures as those of the above-described embodiment will be denoted by the same reference signs and an explanation thereof will be omitted when appropriate.

The shape of the extension portion 27*b* in the bottom wall of the second cap portion 27 of the cap member 21 may be any shape, provided that the extension portion 27*b* extends out from the nozzle facing portion 27*a* to the region 45 where the nozzles 16 are not formed. Hereinafter, explanation will be given, taking several concrete examples.

Figure 7:
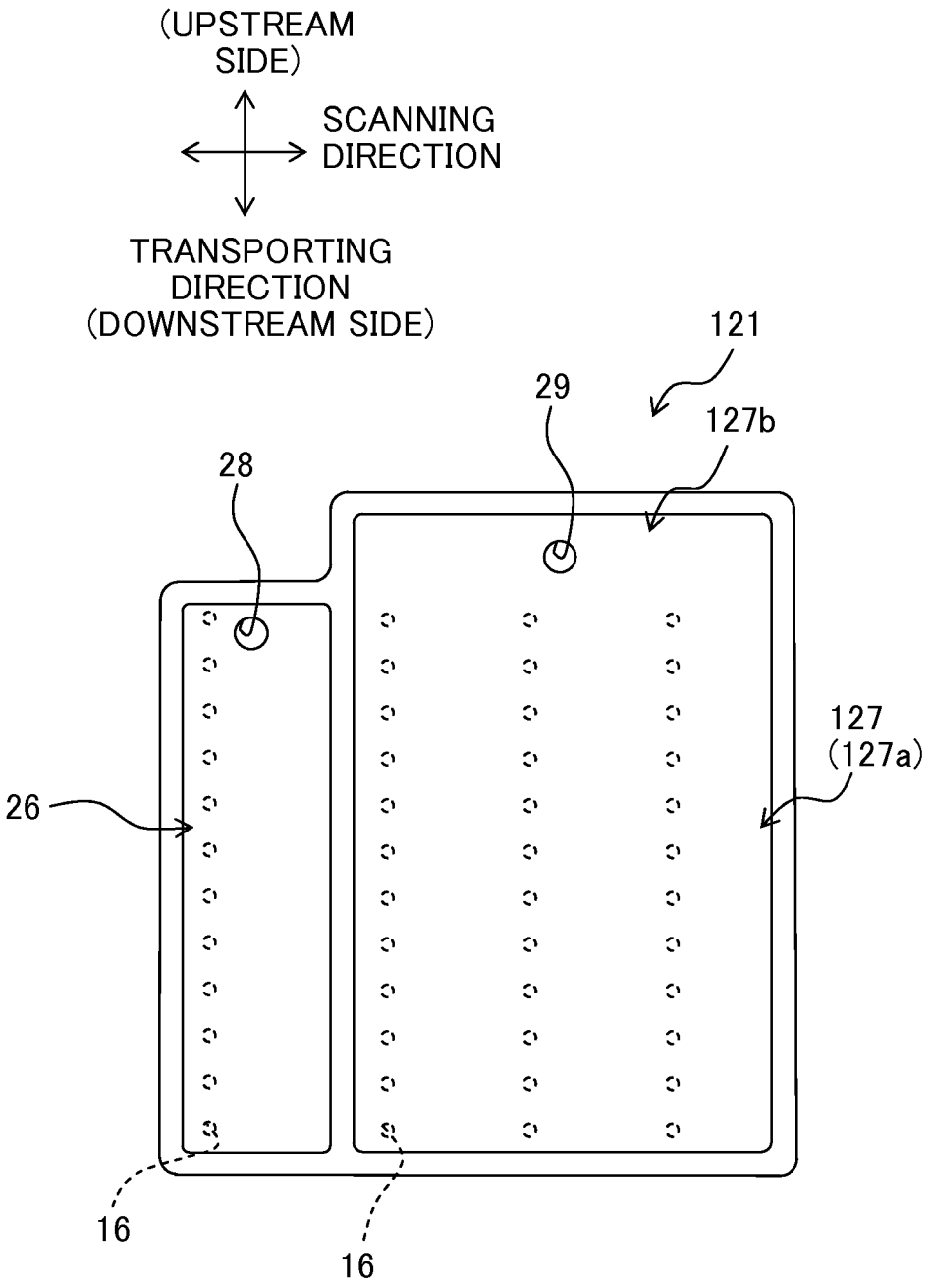
FIG. 7 is a plane view of a cap member in a modification example 1.

In this embodiment, the extension portion 27*b* in the bottom wall of the second cap portion 27 of the cap member 21 locally projects from the nozzle facing portion 27*a*, but as shown in FIG. 7, a bottom wall of a second cap portion 127 of a cap member 121 may have a nozzle facing portion 127*a* in a rectangular shape and an extension portion 127*b* extending out in the transporting direction, with the same scanning-direction width as that of the nozzle facing portion 127*a* (modification example 1). Note that cap chips, though not shown, conforming to the shape of this modification example are housed in the cap portions. According to this structure, a projecting corner is not formed in the lip portion 21*b* by the formation of the extension portion 127*b*, so that sealability is not likely to deteriorate.

Figure 8:
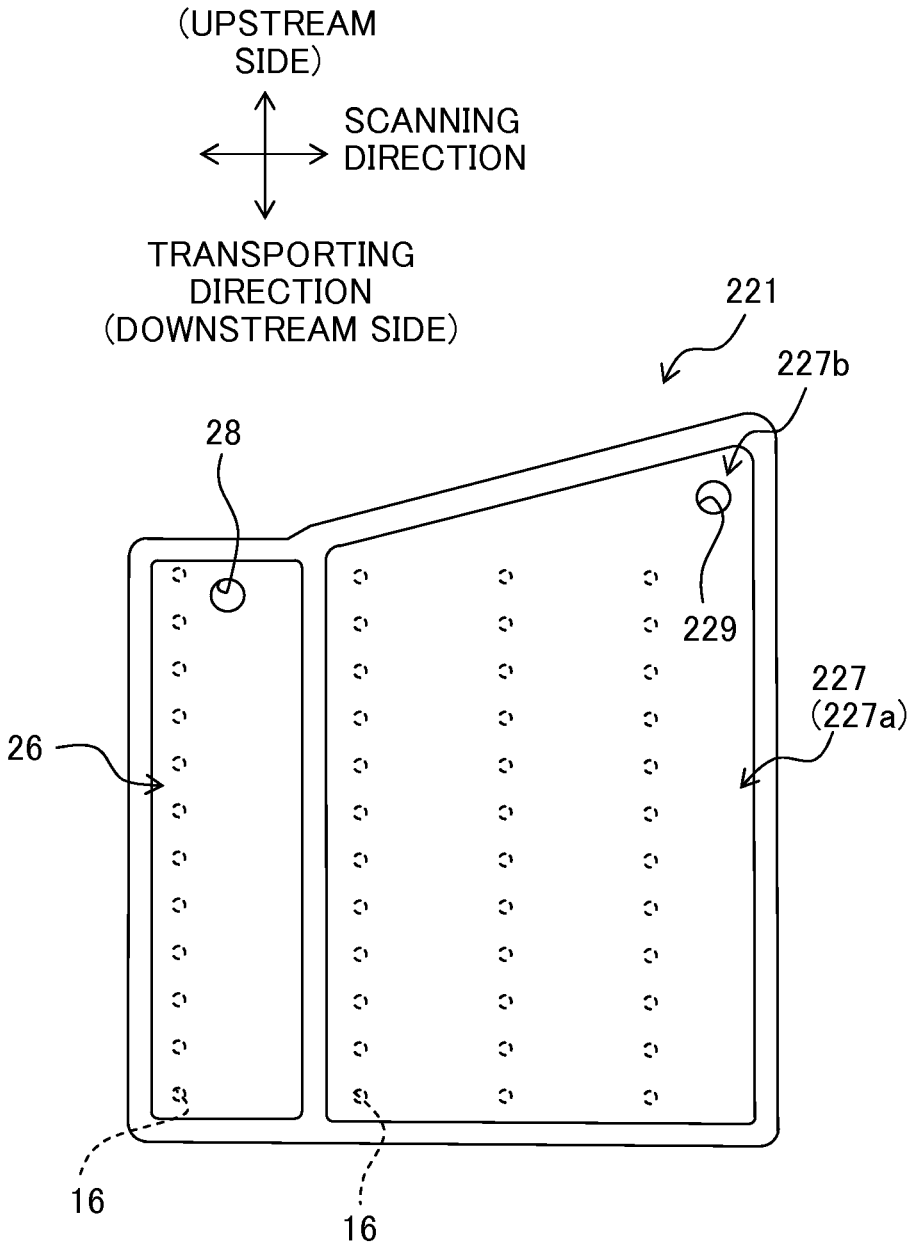
FIG. 8 is a plane view of a cap member in a modification example 2.

In this embodiment, the extension portion 27*b* in the bottom wall of the second cap portion 27 of the cap member 21 locally projects to the upstream side of the transporting direction at the center portion in the scanning direction, but as shown in FIG. 8, a bottom wall of a second cap portion 227 of a cap member 221 may have a nozzle facing portion 227*a* and an extension portion 227*b* locally projecting from the nozzle facing portion 227*a* to the upstream side of the transporting direction at its one end portion in the scanning direction (modification example 2). Note that cap chips, though not shown, conforming to the shape of this modification example are housed in the cap portions. The extension portion 227*b* has the locally projecting shape and a suction port 229 is formed in the extension portion 227*b*, which facilitates the sucking of the ink forming the ink bridge Ia by the suction pump 23 and makes it difficult for the ink forming the ink bridge Ia to spill from the cap member 221, as described above.

Figure 9:
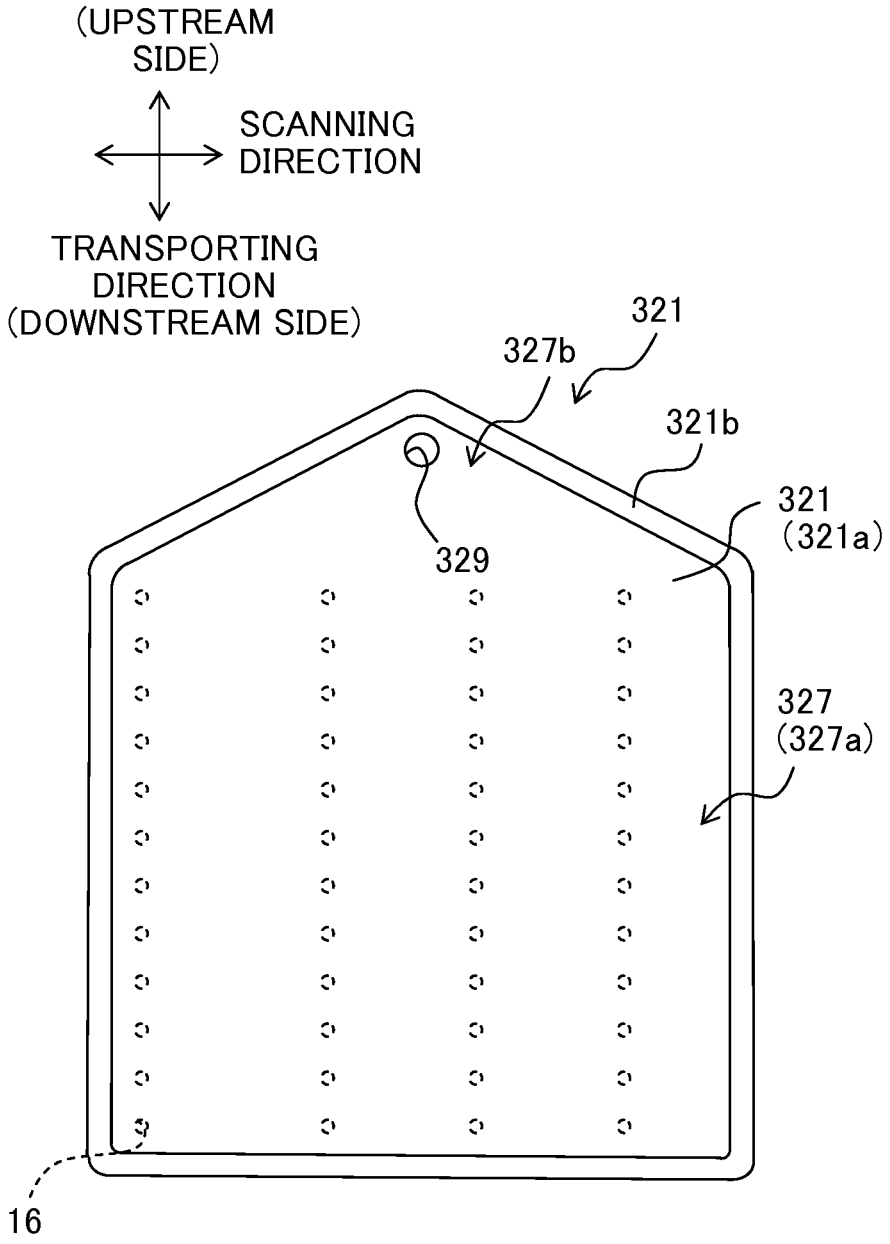
FIG. 9 is a plane view of a cap member in a modification example 3.

Further, in this embodiment, the cap member 21 is partitioned by the partition wall 21*c* into the two cap portions, that is, the first cap portion 26 for covering the black nozzles 16*bk* and the second cap portion 27 for covering the color nozzles 16*c*1, but a structure without the partition wall 21*c* is also adoptable (modification example 3). As shown in FIG. 9, a cap member 321 has a bottom wall 321*a* and a loop-shaped lip portion 321*b* provided upright on an outer periphery of the bottom wall 321*a*, and covers all the nozzles 16. The bottom wall 321*a* has a nozzle facing portion 327*a* facing all the nozzles 16 and an extension portion 327*b* extending out from the nozzle facing portion 327*a*. The extension portion 327*b* projects locally. Note that a cap chip, though not shown, conforming to the shape of this modification example is housed in the cap portion. In this case, the number of suction ports 329 connected to the suction pump 23 may be one, and the switching unit 24 need not be provided. This structure can also provide the same effects as those of the above-described embodiment. Incidentally, the extension portion 327*b* not locally projecting is also adoptable.

Figure 10:
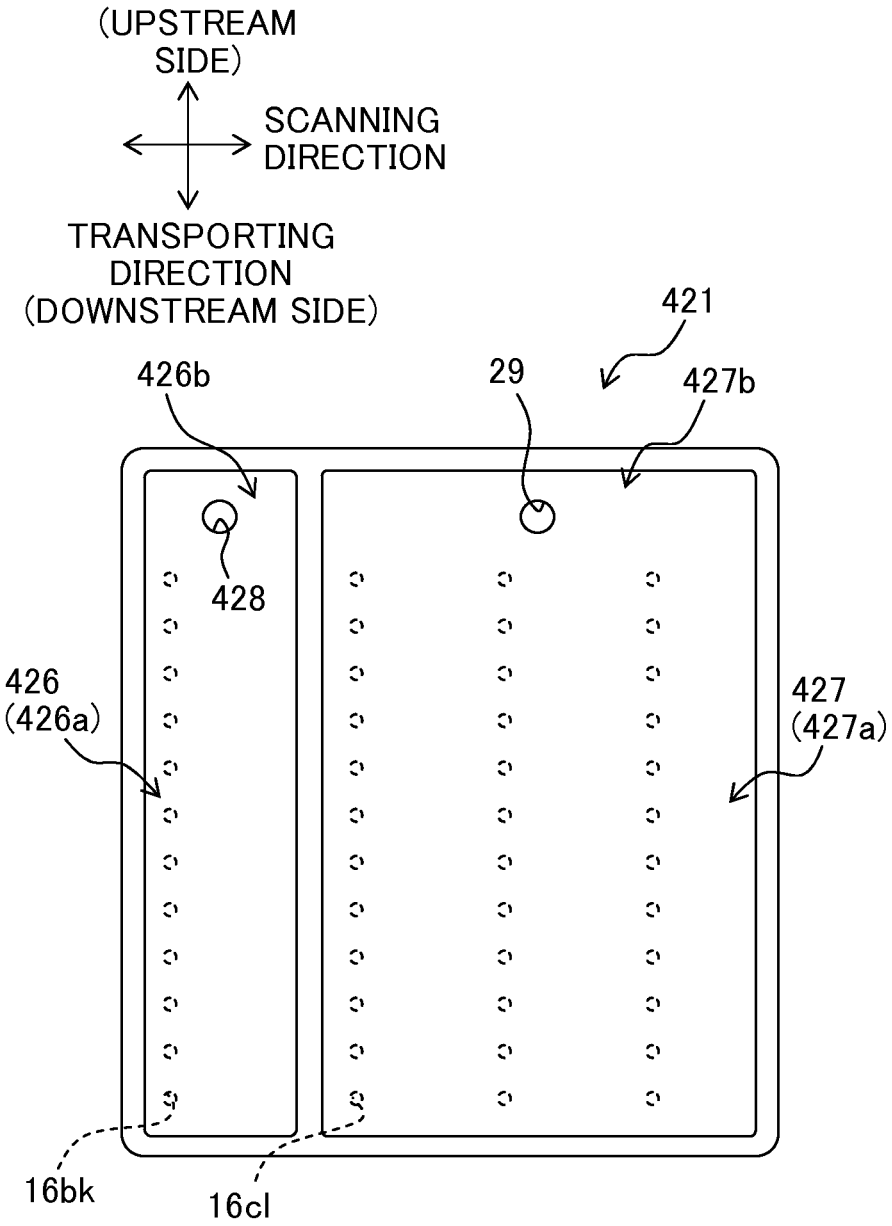
FIG. 10 is a plane view of a cap member in a modification example 4.

Further, in this embodiment, the extension portion 27*b* is formed in the second cap portion 27 of the cap member 21 and the extension portion 27*b* is not formed in the first cap portion 26, but the extension portion may be formed also in the first cap portion 26 (modification example 4). As shown in FIG. 10, a cap member 421 has a first cap portion 426 covering the black nozzles 16*bk* and a second cap portion 427 covering the color nozzles 16*c*1. Bottom walls of the first cap portion 426 and the second cap portion 427 both have nozzle facing portions 426*a*, 427*a* facing the nozzles 16 and extension portions 426*b*, 427*b* extending out from the nozzle facing portions 426*a*, 427*a* respectively. Note that cap chips, though not shown, conforming to the shape of this modification example are housed in the cap portions. In this case, in the extension portion 426*b* in the bottom wall of the first cap portion 426, a suction port 428 is preferably formed in its portion facing the region, of the ink jetting surface 41*a*, where the nozzles 16 are not formed. Incidentally, the extension portions 426*b*, 427*b* may project locally. This modification example is more suitably adopted when the suppression of the connection of the ink bridge Ia and the ink in the nozzles 16 is more desired than the improvement in sealability in the first cap portion 426.

Figure 11A:
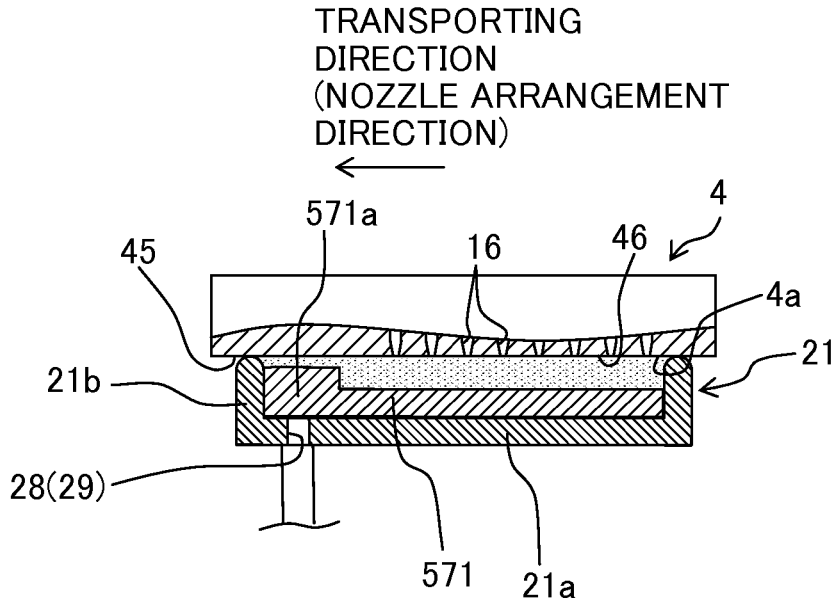
FIG. 11A and FIG. 11B are cross-sectional views of a second cap portion of a cap member and a cap driving mechanism in a modification example 5 when suction purge is being executed, taken along a vertical surface including a transporting direction, FIG. 11A showing a capping state and FIG. 11B showing a state in which the cap member is separated.
Figure 11B:
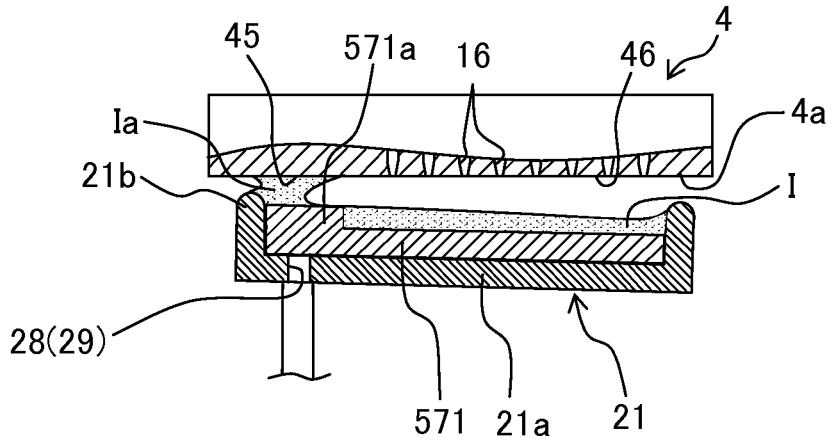

Further, in this embodiment, the rib 71*a* of the cap chip 71 extends in the scanning direction and is disposed with a clearance from the projecting tip portion of the lip portion 21*b* in the transporting direction, but as shown in FIG. 11A, a cap chip 571 may have a larger thickness in its portion 571*a* facing the region 45, of the ink jetting surface 4*a*, where the nozzles 16 are not formed than in its portion facing the nozzle placement region 46 of the ink jetting surface 4*a* (modification example 5). In this case as well, as shown in FIG. 11B, the ink bridge Ia is formed between the tip portion, of the lip portion 21*b*, surrounding the extension portion 27*b* and the ink jetting surface 4*a*, and in addition, the ink bridge Ia is also formed between the portion 571*a* with a larger thickness (thick portion) of the cap chip 571 housed in the cap member 21 and the region 45, of the ink jetting surface 4*a*, where the nozzles 16 are not formed. Therefore, the ink bridges Ia are thus gathered on an inner side of the cap member 21, which makes it difficult for the ink forming the ink bridges Ia to spill to the outside of the cap member 21.

Figure 12A:
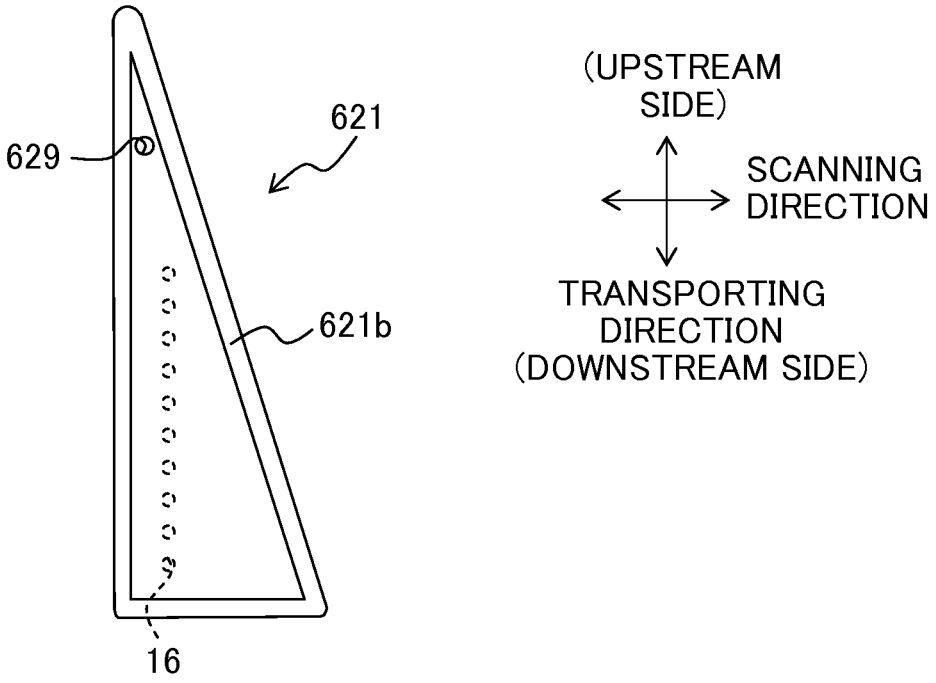
FIG. 12A and FIG. 12B are plane views of a cap member in a modification example 6.
Figure 12B:
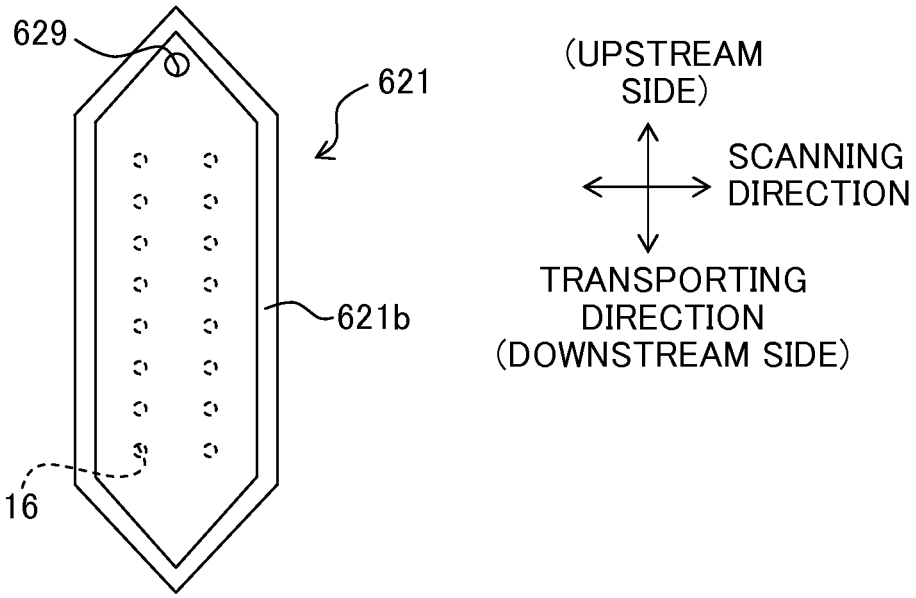

Further, in this embodiment, the shape of the bottom wall of the cap member 21 is hexagonal, but it may be any shape having three sides or five or more sides, and may be, for example, a triangular shape shown in FIG. 12A or may be a hexagonal shape shown in FIG. 12B (modification example 6). A cap member 621 may have a lip portion 621*b* provided upright on an outer periphery of a bottom wall having any of these shapes. Further, in these cases, a suction port 629 penetrating through the bottom wall is desirably formed near any of corners of the bottom wall. Note that a cap chip, though not shown, conforming to the shape of this modification example is housed in the cap member 21.

Further, in this embodiment, the rib 71*a* is formed on the cap chip 71, but the surface, of the cap chip 71, facing the ink jetting surface 4*a* may be a planar surface, without the rib 71*a* formed.

Further, in this embodiment, since the first cap portion 26 and the second cap portion 27 are arranged in the direction (scanning direction) perpendicular to the nozzle arrangement direction, the extension portion 27*b* of the second cap portion 27 extends out in the nozzle arrangement direction, but the first cap portion 26 and the second cap portion 27 may be arranged in the nozzle arrangement direction, the number of the cap portions themselves need not be plural, and when the number thereof is one, the extension portion may extend out in the direction perpendicular to the nozzle arrangement direction.

Further, in this embodiment, the cap member 21 has the two cap portions, but the number of the cap portions may be one or three or more, and an extension portion may be appropriately formed in these cap portions.

In the above-described embodiment, in the cap member 21, the suction ports 28, 29 connected to the suction pump 23 are formed at its end portion separating from the ink jetting surface 4*a* last, but the formation positions of the suction ports are not limited to the above positions.

In the above-described embodiment, the suction purge using the suction pump 23 which is connected to the cap member 21 is explained as an example of a recovery operation by a recovery mechanism. However, the recovery operation by the recovery mechanism is not limited to the suction purge by the suction pump 23. For example, the ink jet printer 1 may be provided with a pressurizing pump which is connected to the ink tanks and which supplies pressurized air to the ink tanks It is allowable to forcibly discharge the inks from the nozzles 16 of the inkjet head 4 by supplying pressurized air to the ink tanks from the pressurizing pump and by supplying inks in the ink tanks to the ink jet head 4, in a state that the cap member 21 comes into contact with the ink jetting surface 4*a* and covers the nozzles 16. In this case, the pressurizing pump is an example of the recovery mechanism of the present teaching. Alternatively, it is also allowable to discharge the inks from the nozzles 16 of the ink jet head 4 to the cap member 21 by driving the piezoelectric actuator 31 of the ink jet head 4, in a state that the cap member 21 comes into contact with the ink jetting surface 4*a* and covers the nozzles 16. In this case, the piezoelectric actuator 31 is an example of the recovery mechanism of the present teaching.

Further, in this embodiment, the present teaching is applied to the ink jet printer which jets the ink onto the recording paper to record characters, images, and so on, but the application of the present teaching is not limited to such use. That is, the present teaching is applicable to various kinds of liquid jetting apparatuses for jetting various kinds of liquids other than ink to targets according to their uses.

What is claimed is:

1. A liquid jetting apparatus which jets a liquid, comprising:

a liquid jetting head which has a liquid jetting surface including a nozzle placement region at which a plurality of nozzles through which the liquid is jetted are open;

a cap member which covers the nozzles of the liquid jetting head and which includes a bottom wall and a loop-shaped lip portion which is provided upright on an outer peripheral portion of the bottom wall to come into close contact with the liquid jetting surface, the bottom wall having a first region which covers the nozzle placement region and a second region which extends out from the first region and which does not face the nozzle placement region;

a cap driving mechanism which moves the cap member to make contact with or separate from the liquid jetting surface of the liquid jetting head;

a recovery mechanism which is connected to the cap member and which performs a recovery operation to discharge the liquid from the nozzles in a state in which the cap member makes contact with the liquid jetting surface; and a plate-shaped cap chip which is accommodated in the cap member to suppress the cap member from deforming during the recovery operation, wherein the cap driving mechanism tilts the cap member so as to cause the first region to separate from the liquid jetting surface earlier than the second region under a condition that the cap member separates from the liquid jetting surface, and wherein on a portion of the cap chip, corresponding to the second region, a thick portion, which has a thickness greater than a portion corresponding to the first region, is provided.

2. The liquid jetting apparatus according to claim 1, wherein the second region has a shape locally projecting from the first region.

3. The liquid jetting apparatus according to claim 1, wherein the nozzles are divided into a first nozzle group and a second nozzle group having a larger number of the nozzles than the first nozzle group, the cap member has a first cap portion which covers the first nozzle group and a second cap portion which covers the second nozzle group, and the second region is provided only in the second cap portion.

4. The liquid jetting apparatus according to claim 3, wherein the liquid includes a plurality of kinds of liquids, one kind of liquid is jetted from the nozzles belonging to the first nozzle group, and at least two kinds of liquids are jetted from the nozzles belonging to the second nozzle group.

5. The liquid jetting apparatus according to claim 1, wherein the thick portion of the cap chip is a rib provided upright with a clearance from a portion, of the lip portion, surrounding the second region.

6. The liquid jetting apparatus according to claim 1, wherein in the second region of the bottom wall of the cap member, a suction port to which the recovery mechanism is connected is formed.

7. The liquid jetting apparatus according to claim 1, wherein the nozzles are aligned in a predetermined direction, and the second region of the bottom wall of the cap member extends out from the first region in the predetermined direction.

8. The liquid jetting apparatus according to claim 1, wherein the bottom wall has three sides or five or more sides.

9. The liquid jetting apparatus according to claim 8, wherein a through hole is formed near a corner of the bottom wall.

10. A liquid jetting apparatus which jets a liquid, comprising:

a liquid jetting head which has a liquid jetting surface including a nozzle placement region at which a plurality of nozzles through which the liquid is jetted are open;

a cap member which covers the nozzles of the liquid jetting head and which includes a bottom wall and a loop-shaped lip portion which is provided upright on an outer peripheral portion of the bottom wall to come into close contact with the liquid jetting surface, the bottom wall having a first region which covers the nozzle placement region and a second region which extends out from the first region and which does not face the nozzle placement region;

a cap driving mechanism which moves the cap member to make contact with or separate from the liquid jetting surface of the liquid jetting head; and a recovery mechanism which is connected to the cap member and which performs a recovery operation to discharge the liquid from the nozzles in a state in which the cap member makes contact with the liquid jetting surface, wherein the cap driving mechanism tilts the cap member so as to cause the first region to separate from the liquid jetting surface earlier than the second region under a condition that the cap member separates from the liquid jetting surface, wherein the nozzles which are open in the nozzle placement region are aligned in a predetermined direction, wherein the liquid jetting head further includes: a liquid supply port which is formed on a surface opposite to the liquid jetting surface in a region not corresponding to the nozzle placement region; a filter which covers the liquid supply port; and a common liquid chamber which communicates with the liquid supply port, extends in the predetermined direction, and communicates commonly with the nozzles, and wherein the second region faces a region of the liquid jetting surface corresponding to the filter in a state that the cap member covers the nozzles of the liquid jetting head.

11. The liquid jetting apparatus according to claim 10, wherein the second region has a shape locally projecting from the first region.

12. The liquid jetting apparatus according to claim 10, wherein the nozzles are divided into a first nozzle group and a second nozzle group having a larger number of the nozzles than the first nozzle group, the cap member has a first cap portion which covers the first nozzle group and a second cap portion which covers the second nozzle group, and the second region is provided only in the second cap portion.

13. The liquid jetting apparatus according to claim 12, wherein the liquid includes a plurality of kinds of liquids, one kind of liquid is jetted from the nozzles belonging to the first nozzle group, and at least two kinds of liquids are jetted from the nozzles belonging to the second nozzle group.

14. The liquid jetting apparatus according to claim 10, further comprising:

a plate-shaped cap chip which is accommodated in the cap member to suppress the cap member from deforming during the recovery operation, wherein on a portion of the cap chip, corresponding to the second region, a thick portion, which has a thickness greater than a portion corresponding to the first region, is provided, and wherein the thick portion of the cap chip is a rib provided upright with a clearance from a portion, of the lip portion, surrounding the second region.

15. The liquid jetting apparatus according to claim 10, wherein in the second region of the bottom wall of the cap member, a suction port to which the recovery mechanism is connected is formed.

16. The liquid jetting apparatus according to claim 10, wherein the second region of the bottom wall of the cap member extends out from the first region in the predetermined direction.

17. The liquid jetting apparatus according to claim 10, wherein the bottom wall has three sides or five or more sides.

18. The liquid jetting apparatus according to claim 17, wherein a through hole is formed near a corner of the bottom wall.

* * * * *